US005361554A

United States Patent [19]

Bryan

[11] Patent Number: 5,361,554

[45] Date of Patent: Nov. 8, 1994

[54] PREFABRICATED DECK SYSTEM

[76] Inventor: Robert Bryan, 4269 Lakeshore Blvd., West, Unit #2206, Etobicoke, Ontario, Canada

[21] Appl. No.: 972,929

[22] Filed: Nov. 6, 1992

[51] Int. Cl.[5] ..... E04B 9/00

[52] U.S. Cl. ..... 52/480; 52/87; 52/586.1

[58] Field of Search ..... 52/87, 384, 385, 589.1, 52/585.1, 586.1, 177, 480, 507, 665, 779, 79.6

[56] References Cited

U.S. PATENT DOCUMENTS

| | | | |
|---|---|---|---|
| 3,300,936 | 1/1967 | Travaglia | 52/477 |
| 3,504,472 | 4/1970 | Clement | 5/169.1 X |
| 3,513,786 | 5/1970 | Kellogg | 52/585 |
| 3,579,941 | 5/1971 | Tibbals | 52/384 |
| 4,028,858 | 6/1977 | Rehbein et al. | 52/384 |
| 4,051,639 | 10/1977 | Lombardi | 52/64 |
| 4,575,982 | 3/1986 | Wenger | 52/384 X |
| 4,628,645 | 12/1986 | Tafelski | 52/169.1 |
| 4,999,964 | 3/1991 | Taylor | 52/477 |

*Primary Examiner*—Carl D. Friedman
*Assistant Examiner*—Beth A. Aubrey
*Attorney, Agent, or Firm*—Cushman, Darby & Cushman

[57] ABSTRACT

A suspended deck system uses prefabricated deck block modules as the working surface. Each block comprises a series of lateral beam bars in closely spaced, mutually parallel relation, having their ends secured by tie members splined in place. In one embodiment the deck blocks are of square plan-form, having wooden beam bars of substantially square section, with eased edges, having their ends tied by a thin, elongated wood spline. The block thickness and the length of the beam bars are selected to ensure the necessary bending strength when simply suspended by their ends in a loaded condition, as part of a suspended platform. In the case of a wooden decking the deck blocks are supported upon a framing of joists and cross-braces having rabetted upper edge recesses into which the deck blocks fit in flush-fitting relation. The blocks may be positioned in an alternating pattern, giving a visual parquet effect. In the deck frame ribbed dowel pins are used to secure the ends of the respective headers, joists and cross braces. Adoption of two standard sizes of joists and frame headers permits the building up of a wide range of platform sizes while requiring a minimum stock of prefabricated platform frame elements for use with the block modules. An alternative approach provides a second embodiment in regard to securing the deck block module to the deck frame. This alternative is to rabet the under face of the deck blocks, while leaving unrecessed the underlying framing of joists, headers and cross-braces. Further embodiments incorporate other forms of lateral restraint to position the deck blocks, relative to the supporting framing. The system also has wide application for walks and docks.

11 Claims, 7 Drawing Sheets

PREFABRICATED DECK SYSTEM

TECHNICAL FIELD

This invention is directed to a prefabricated deck system, and in particular to a replaceable, prefabricated modular deck surface and pre-fabricated sub-structure.

BACKGROUND ART

The provision Of a raised wooden outside deck is commonplace in a great many North American homes, frequently being combined with sliding patio doors that give access to the deck or patio.

Such decks are usually built of lumber, having a supporting frame and sub-structure, including joists and headers, to which a decking of solid board lumber is nailed. Many decks are subject to severe climatic conditions that cause shrinking and working of the boards, leading to cracking of the boards and partial drawing of the nails. This is both unsightly, and a safety hazard, while the nails can rust and cause discoloration.

Such decks are frequently painted, for cosmetic purposes, the presence of so many nails making a natural wood finish impractical.

In a painted deck of continuous, nailed-down boards the nature of the decking and the usually confined sub-structure virtually precludes ready painting of the under surfaces thereof. Thus the upward passage of moisture through the boards tends to lift the paint, with consequent short life term.

A form of wooden deck tread or "tile" has previously been developed, having a nail-less structure, in which a wooden surface of deck tread units is laid upon concrete sub-flooring, such as balconies and the like, in the manner of laying tiles.

The deck tread units comprise lateral tread bars, the ends of which are threaded upon a rope-like tying element such as a hollow plastic hose. Each end of the tread bars is drilled, laterally, to provide an aperture into which the tying element is inserted. This construction is time consuming and expensive to machine, particularly in the drilling of the end apertures, while the insertion of the flexible tying elements is laborious, time consuming and difficult. Such tread units are unsuited for use with a suspended deck system, due to the undue skewing flexibility, and difficulty in maintaining dimensional standardization.

Certain other somewhat less relevant aspects of modular decking or patio structures are to be found in U.S. Pat. Nos:

3,300,936 January 1967, Travaglia
4,028,858 June 1977, Rehbein
4,628,645 December 1986, Tafelski
4,999,964 March 1991, Taylor

DISCLOSURE OF THE INVENTION

The present invention provides a prefabricated deck block for surfacing a deck. The subject deck block comprises a series of lateral bars in closely spaced, mutually parallel relation, having a common tie members splined in place at each end of each bar.

The subject deck blocks may be laid upon an existing support surface, or they may be integrated as a suspended deck surface into a pre-fabricated deck sub-structure having a series of surface recesses into which the individual blocks are laid in close, flush fitting relation with the deck supporting members of the sub-structure.

Each lateral bar of each deck block has a narrow spline recess traversing the end of the bar, into which a suitable spline member is inserted, so as to secure the bars in mutually spaced, parallel relation. A steel staple driven through one face of the lateral bar and into the spline member in locking engagement therewith provides low cost, unobtrusive securement of the block elements.

The spline recesses are readily and rapidly formed into the ends of the lateral bars as part of the manufacturing process, by means of a saw cut, or the like. The adoption of thin, wide spline members of wood imparts lateral rigidity to the block, to retain its shape, while permitting accommodating longitudinal flexure of the block.

A particular advantage afforded by the structure of the present invention is the facility with which the decking blocks may be lifted and reversed. This capability makes possible the painting of the reverse face of the decking blocks, thereby vapour-proofing and water-proofing the blocks against upward penetration of water vapour from below. This, in turn prolongs the service life of the painted block upper surfaces, which are otherwise most susceptible to degradation due to the upward penetration of water vapour, which lifts the top paint.

The deck sub-structure, which is preferably prefabricated, comprises a deep section main frame of joists and headers, with cross-braces of shallower section. The upper edges of all the sub-structure members are rabetted.

The rabetted longitudinal edges of the joists, headers and cross-braces are preferably rabetted to the depth of the deck blocks. Thus, when the deck sub-structure is assembled a series of adjacent square receses are provided, into which the deck blocks fit quite precisely, without requirement of nailing, to give a flush fitting, nail-free deck floor. Generally the deck blocks are oriented with the staples located on the underside. The use of deck blocks of square plan enables the blocks to be oriented in a parquet arrangement, with the lateral bars of alternate blocks arranged mutually at right angles, i.e., north/south or east/west, figuratively speaking.

The attachment of deck sub-structure cross-braces generally includes a recessed lower portion of each cross-brace, to form a projecting tongue, supported upon the rabetted joist, or header.

In an alternative embodiment the deck sub-structure may be left unrecessed, with the reverse face of the deck blocks having the edges thereof rabetted in order to provide a locating fit with the deck sub-structure.

In addition to securely locating the deck blocks, the provision of rabetted corners to the blocks or to the deck sub-structure tends to stabilize the joists, members and cross-braces of the sub-structure against warpage.

An alternative embodiment utilizes a lateral restraint barrier for this purpose. Such a barrier may be readily provided by centrally grooving the top surfaces of the sub-structure with a narrow groove into which a suitable restraint means such as steel strapping may be edge-mounted. This then serves to keep the deck blocks effectively centered on the support structure and to ensure that the deck blocks cannot drop, unsupported, between the supporting members.

As a further embodiment the deck blocks may be made asymetrical, by off setting the spline recesses and extending the splines outside the block ends by a predetermined amount. This then facilitates the assembly of the blocks in mutual spacing relation, such that wood screws, preferably of the Roberston type may be inserted through two of the overlapped extended splines, and into the supporting sub-frame member, in lateral restraining relation with the deck blocks.

The provision of longitudinal slots in top surfaces of the joists and other members of the sub-frame, to receive the lateral restraint strips, is both cost effective and minimizes the reduction in strength of the respective sub-frame members.

A further lateral restraint embodiment is the application of a simple screw or nail-on barrier.

On such embodiment may comprise a serpentine strip of steel strapping or the like, having the crests thereof well below the height of the deck blocks, and nailed in some of the valleys to the sub-frame members, in use to serve as lateral restraints, to locate and retain the deck blocks securely in position.

Assembly of the respective sub-structure components of the suspended deck preferably utilizes plain butt joints secured in flush abutting relation by way of ribbed dowell pins.

Such pins, made of engineering plastic, are very strong, and when driven home into a suitably pre-drilled wooden member, resist dis-assembly to the point of requiring to be cut free.

The present system utilizes precision jig pre-drilling of the respective sub-structure members, to assure standardized interchangeability of the members.

It is contemplated that the adoption of longitudinally flexible spline members such as steel strapping with suitable spacing of the lateral bars will permit the provision and use of long lengths of prefabricated decking which may be rolled up for transportation.

The sub-structure cross-braces may be suitably recessed to accommodate such elongated decking units. One such arrangement may include spacing of the deck block lateral bars to permit upward projection of an edge portion of a cross-brace in locating relation between an adjacent pair of lateral bars.

Alternatively, the lesser required number of cross-braces may be fully recessed below the decking unit cross-bars.

In instances where positive attachment, of deck blocks to the sub-structure is a requirement, the in-splined tie members may be nailed or screwed through, by insertion of hold-down fasteners, located between adjacent lateral bars of the deck block.

The adoption of square recessed hold down screws of the Robertson type is preferred, to facilitate ready retrieval thereof during deck replacement, while yielding a plain deck with no likelihood of protruding nails or other fastening devices. The rabetted joists and header members accommodate a suitable finishing trim piece. This also lends itself to future deck expansion, while the system is well suited for erection by home handymen and do-it-yourself use.

The adoption of a sub-structure having a main frame comprising joists and headers, with cross-braces of shallower section, all with rabetted top edges to receive the deck blocks preferably includes joists that are "notched" at one end. That is to say, the rib which constitutes the top portion of a rabetted joist member extends a short distance beyond the under-portion of the joist, in order for the rib to support the end of the joist on the rabetted shoulder of the adjoining header member. In order to achieve this, the joist under-portion is set back or "notched".

By adopting main frame joist and header components wherein each joist has one end notched and the other end plain, in combination with headers having plain ends, and with joists of a given dimension such as six feet in length and headers such as eight feet in length, then main frames can be readily built up in a range of sizes.

Thus, for a twelve by sixteen (feet) deck, the headers comprise two at each end of the deck, giving the desired sixteen foot dimension, together with pairs of joists, to give the required twelve foot dimension.

The plain ends of the joists are butted together, being supported upon a pier or the like at their juncture, with the joist outer notched ends having the extended rib portions thereof supported on shoulder portions of the rabetted headers.

The associated cross-brace, or cross-braces serve, by way of an oblique dowel pin pattern, to secure the joist ends together.

For a sixteen by fourteen deck, the joists can comprise a joist member (six feet) abutted with a header (8 feet).

For a twenty by twelve deck, the twenty foot dimension can comprise two outer joist members and an intermediate header in abutting relation therebetween.

In some instances it may prove desirable to notch some of the headers on site, to provide a continuous rabetting pattern, primarily for visual effect.

It will be understood that much of the vertical shear strength of the joints of the sub-free is provided by the ribbed dowel pins, which are sized and of sufficiently high tensile and shear strength material to carry all the design load, including an adequate safety factor. The load transfer characteristic of the ribbed pins when driven home into the pre-drilled anchor holes in the wood members precludes the likelihood of the pulling apart of the sub-structure members.

It will be understood that a sub-structure could be used wherein the joist members are not notched. However, such an arrangement would complicate assembly of the sub-structure by a do-it-yourselfer, for whom the protruding rib of a notched joist member serves as a locating template and an ancilliary support during assembly.

In general, the decking system according to the present invention is intended for assembly requiring primarily a suitable hammer. As explained above, in some instances a few simple saw cuts may also be required.

In preparation, the provision of joists and cross-braces having ribbed dowel pins installed therein is preferred.

The two ends of the cross-braces are preferably asymmetrical, each having a pair of dowel pin recesses drilled in oblique relation, the obliquity of the two ends being opposed.

The jig drilled joists are through-drilled, with a rectangular four-hole drilling pattern, such that on one face of the joist a first cross-brace may be attached, with the dowel pins thereof diagonally engaging two of the four joist holes, and on the reverse face of that joist a second cross-brace in aligned, end to end relation with the first cross-brace has the dowel pins thereof diagonally occupying the other two of the four pre-drilled joist holes.

It will be understood that the selection of diagonally located dowel pin arrangements may be varied. However, this may result in the loss of utility of the cross-braces in holding together the abutting ends of pairs of joists. The adoption of the alternative form of deck blocks having the under-edges thereof rabetted, can simplify the requirements of the sub-frame, the timbers of which are unrecessed and unnotched.

In addition to use as decks, the present system also lends itself to pathways and for docks, the deck blocks being retrievable for off-season storage.

Seasonal repainting also is greatly facilitated.

BRIEF DESCRIPTION OF DRAWINGS

Certain embodiments of the invention are described by way of example, without limitation of the invention thereto, reference being made to the accompanying drawings, wherein.

BEST MODE OF CARRYING OUT THE INVENTION

Figure 1:
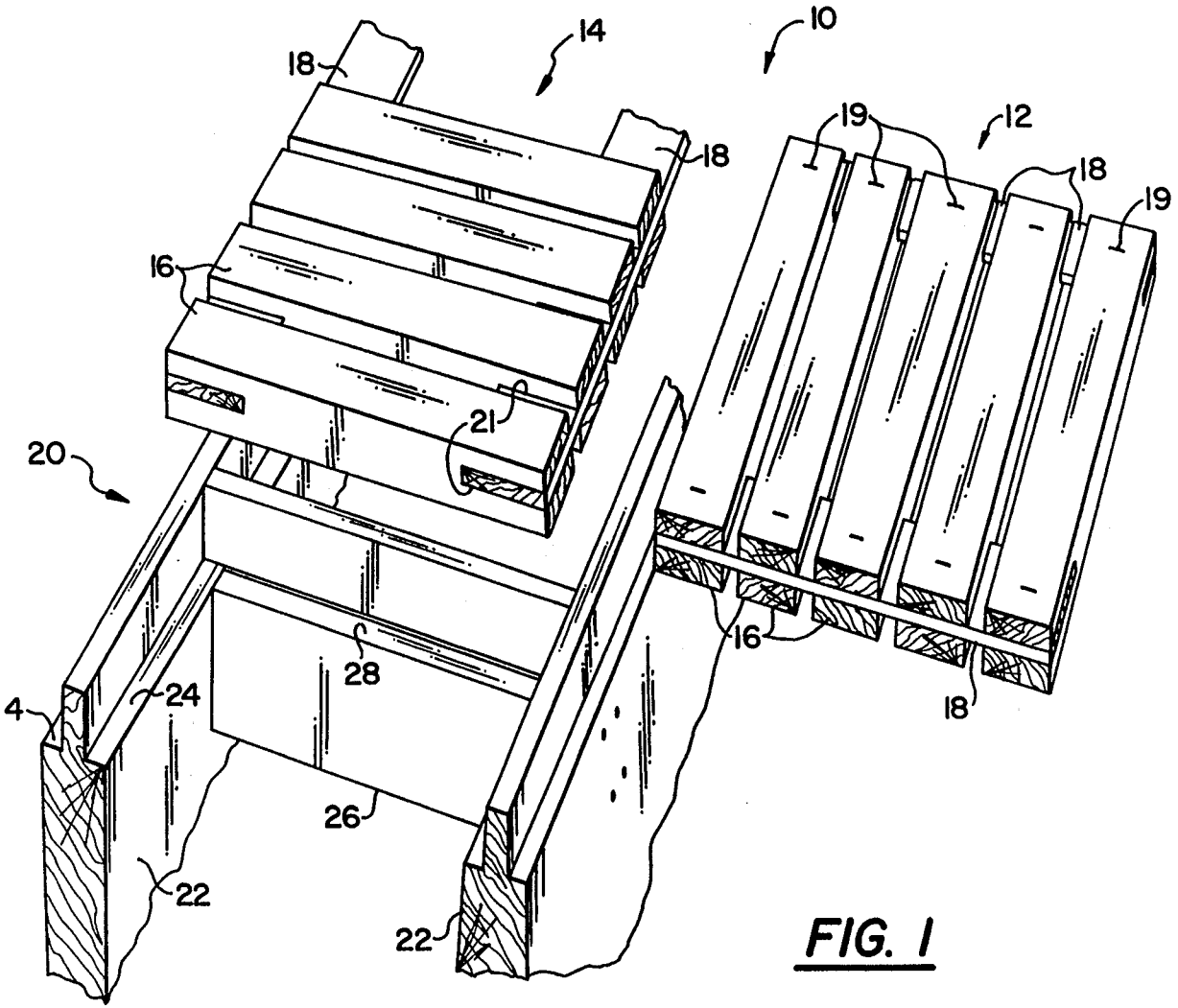
FIG. 1 is a perspective view from above showing a pair of adjacent deck blocks, and a typical portion of deck sub-structure in spaced relation therebeneath.

Referring to FIG. 1 a portion of deck structure 10 comprises deck block 12, and a portion of block 14, the blocks being illustrated as being of square planform. Each deck block 12, 14 comprises lateral wooden bars 16 of substantially square section, with eased corner edges, and a slender wood spline 18 inserted in close fitting relation in the slotted ends of bars 16. Elongated steel staples 19, shown in the reverse face of block 12, penetrate and secure the wood spline 18. Each intermediate bar 16, being solely end supported, is in essence a beam.

The staples 19 are effectively flush with the undersurface of the block 12, holding the inner edge of the spline 18 firmly positioned against the inner edge of the respective slots 21 within which it is seated, thereby stabilizing the block against undue skew.

The blocks retain a certain degree of stiff skewability, to facilitate accommodation to the deck sub-structure.

In one embodiment the bars 16 are of 2-inch by 2-inch (nominal) section, the spline 18 of 2-inch wide by 3/16 inch thick softwood. The blocks 12, 14 are preferably made up in 18-inch by 18-inch or 24-inch by 24-inch units, depending upon intended use, users preference and local load rating by-laws.

Figure 9:
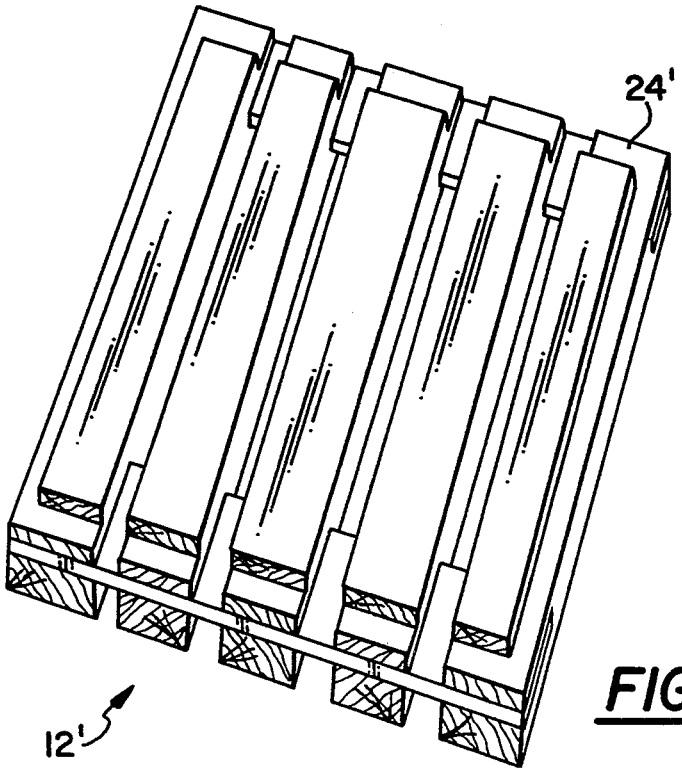
FIG. 9 is an inverted plain view of a rabetted deck block.

Referring to FIG. 9, the block embodiment 12' has a peripheral recess or rabet 24' about the periphery of its reverse face, usually machined after assembly of the blocks 12'.

Figure 2:
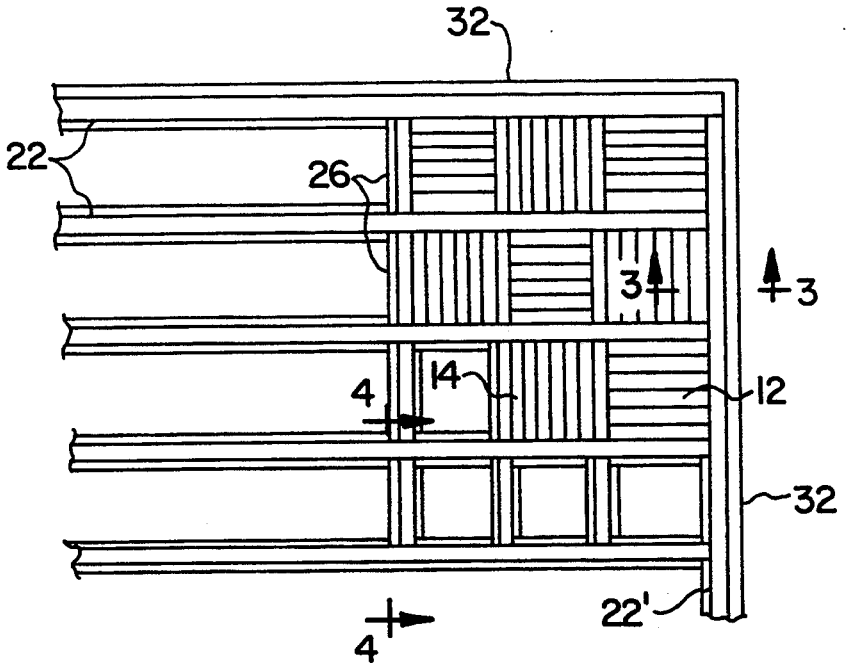
FIG. 2 is a plan view of a portion of a deck sub-structure with some deck blocks inserted in parquet-block arrangement therein.
Figure 3:
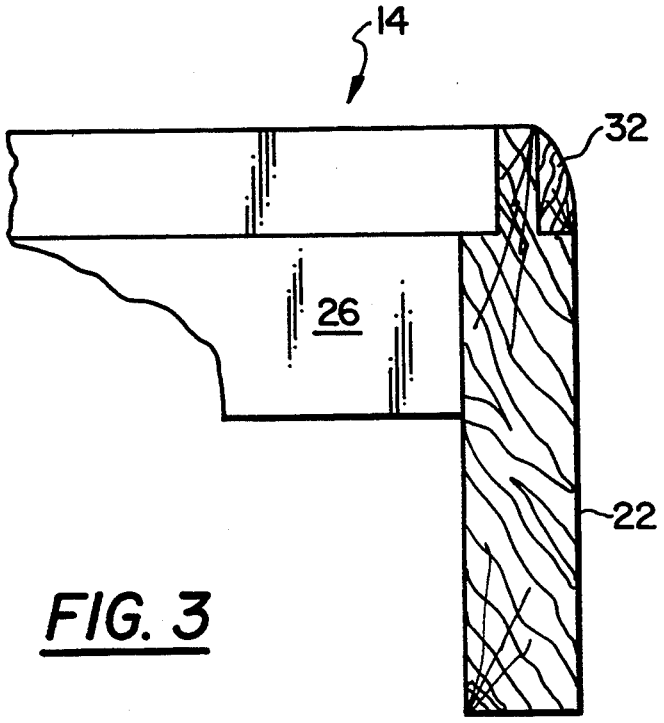
FIG. 3 is a part-section taken at 3—3 of FIG. 2.
Figure 4:
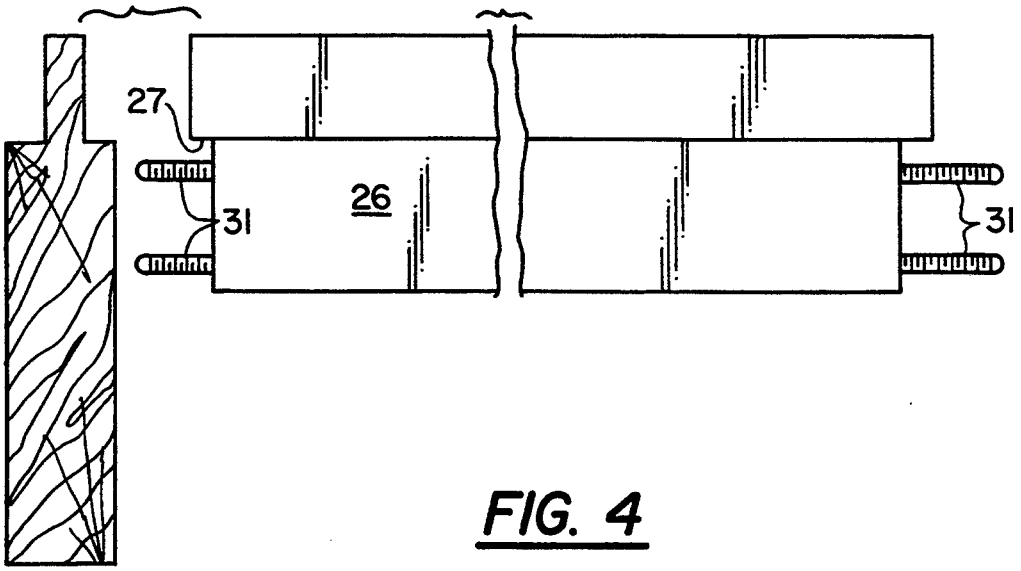
FIG. 4 is a part-section taken at 4—4 of FIG. 2.

Referring also to FIGS. 2, 3, and 4 the underlying sub-structure 20 comprises headers 22' supporting joists 22, both headers and joists having rabetts 24 along the top longitudinal edge corners thereof, the rabetts 24 normally being recessed to the depth of the blocks 12, 14. Cross-brace members 26 have similar rabetts 28.

In the preferred embodiment the joists each have one end thereof notched, leaving the upper tongue portion 27 protruding by the extent of the rabett 24 of the header upon which the joist rests, and to which it is pinned, by way of drive pins 37.

In the case of the transverse closing header member 22' to which the ends of the joists 22 are attached, this member has the upper longitudinal edges thereof rabetted on both sides, the outer rabett receiving a shaped trim piece 32 which may be used to frame the exposed joist edges of the deck.

The sub-structure used in conjunction with rabetted blocks 12' may be of non-rabetted joists, headers and cross-braces, to receive the rabetted blocks 12' in fitting relation therein.

Figure 5:
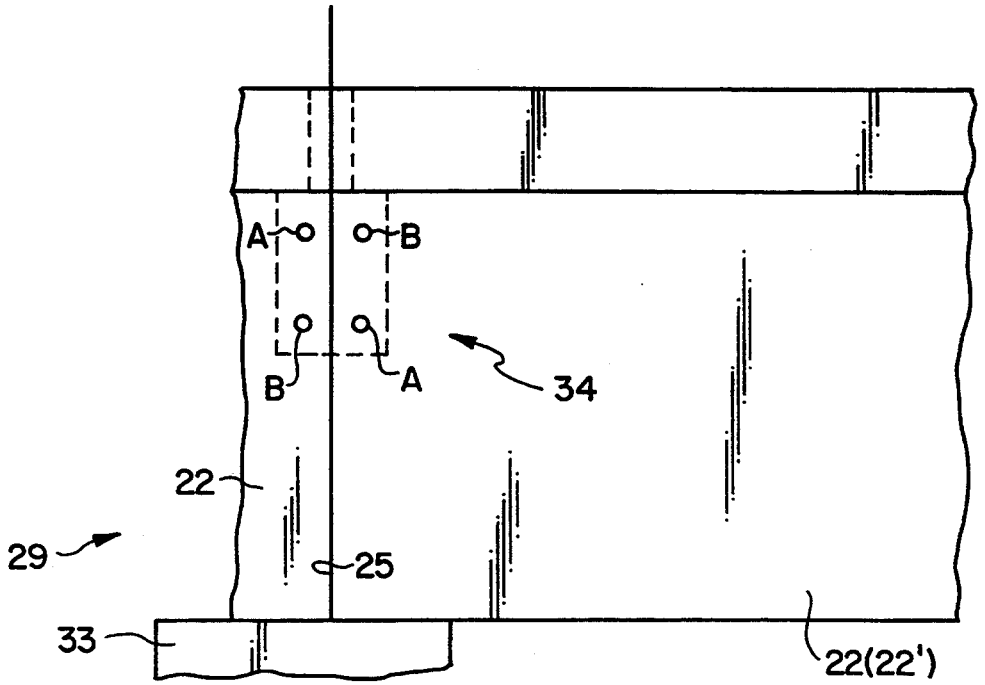
FIG. 5 is a side elevation of a sub-frame butt joint.

Referring to FIG. 5, a joist arrangement 29 may comprise the "inner" (un-notched) end of joist 22, supported upon a pier 33 in abutting relation with the end of a header 22' which is normally un-notched, or the "inner" (un-notched) end of a joist 22.

A precision drilled pattern of dowel holes 34 consisting of two adjacent pairs of holes A, B is drilled adjacent the ends of the respective joist and/or header members. The attachment of a cross-brace member 26 by insertion of the respective drive pins 31 serves to maintain the interface 25 in joined relation.

Figure 7:
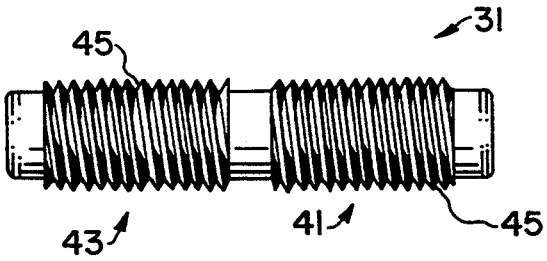
FIG. 7 is a side view of a ribbed dowel pin.

The drive pins 31 (FIG. 7) are of nylon or other higher strength engineering plastic. The pins 31 are double ended, each end 41, 43 having a series of inwardly tapered annular ribs 45. Using a precisely undersized drill to drill dowel holes 34, each pin 31 may be readily positioned, and driven home to half its length in anchored relation within a respective dowel hole 34.

Such is the anchoring effect of the multiple resilient ribs 45, the pins 31 are permanently anchored in their holes and generally are not withdrawable.

Figure 6:
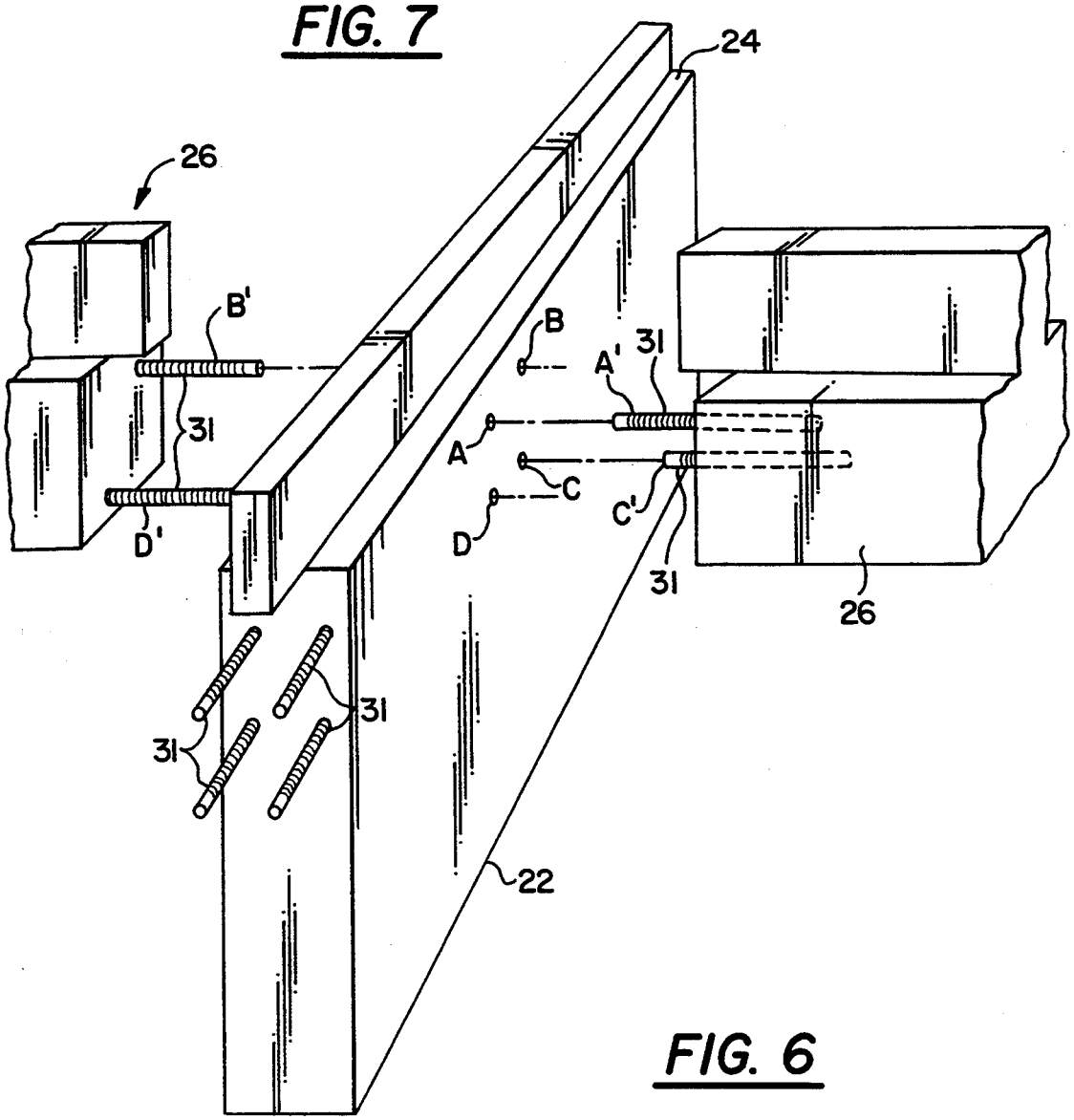
FIG. 6 is a perspective end view in exploded relation showing cross-brace members backing to a joist.
Figure 8:
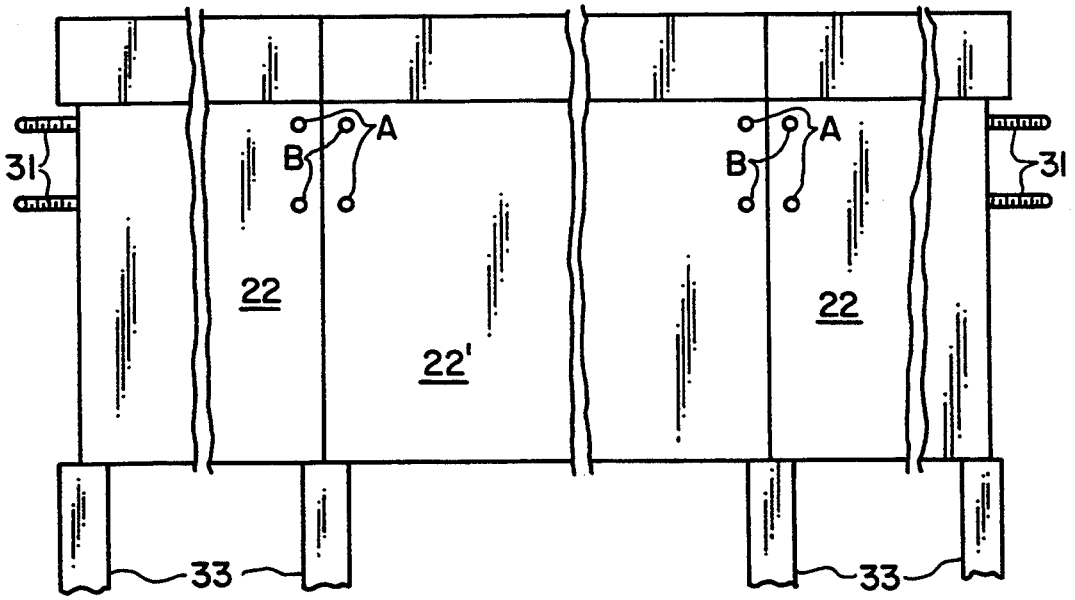
FIG. 8 is a side view of a sub-frame joist combination.

Referring to FIG. 6, a joist 22 is shown having a cross-brace 26 to be inserted from the left and a second cross-brace 26 to be inserted from the right.

The drive pins 31, nominated B' and D', for the left hand insertion will occupy dowel holes B and D, and extend through the thickness of joist 22. The drive pins 31 nominated A', C' will occupy dowel holes A and C and also extend through the width of joist 22.

The adoption of this system, having pre-drilled dowel holes, with drive pins 31 mounted on the ends of the cross-braces 26 provides a support structure that is easily assembled, and requiring the use only of a hammer.

Figure 10:
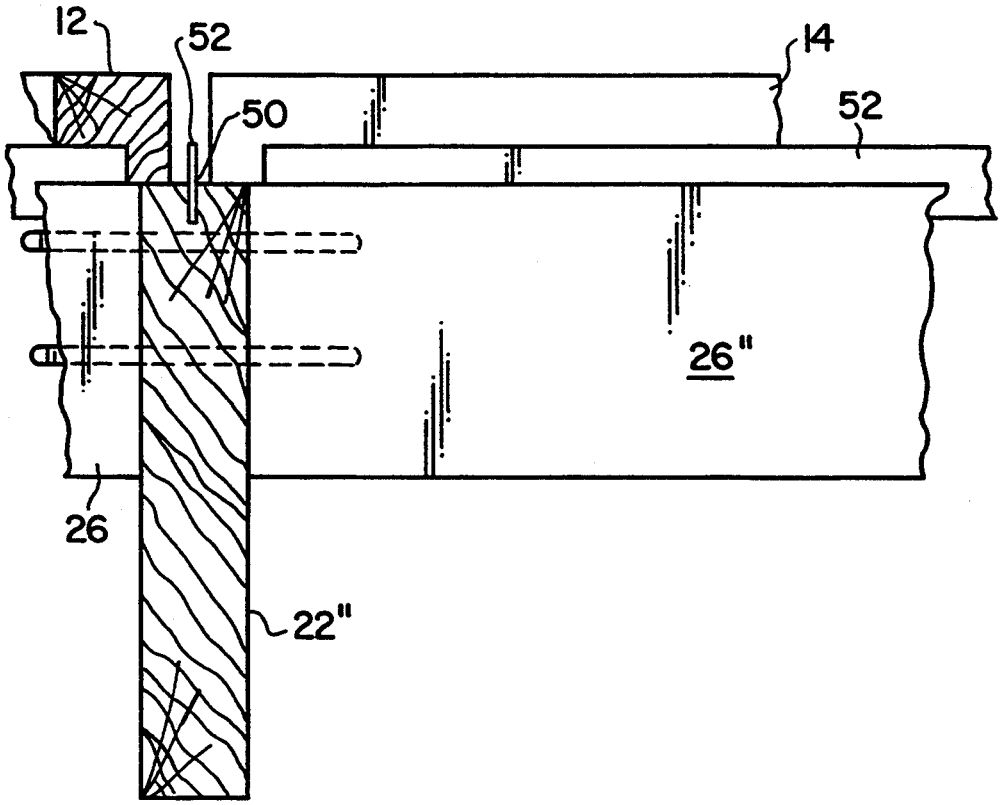
FIG. 10 is an end view of an arrangement incorporating lateral restraint strips.

Referring to FIG. 10, the joist member 22'' is shown in cross-section, having a narrow slot 50 centered longitudinally therein, with a lateral restraining piece 52 secured therein, in the form of a stiff steel or other strip. The cross-braces 26'' that are shown pegged to the joist 22'' also are shown having central slots into which the restraining strips 52 are secured.

The deck block 12 and adjacent deck block 14 are positioned in a "parquet" arrangement.

Figure 11:
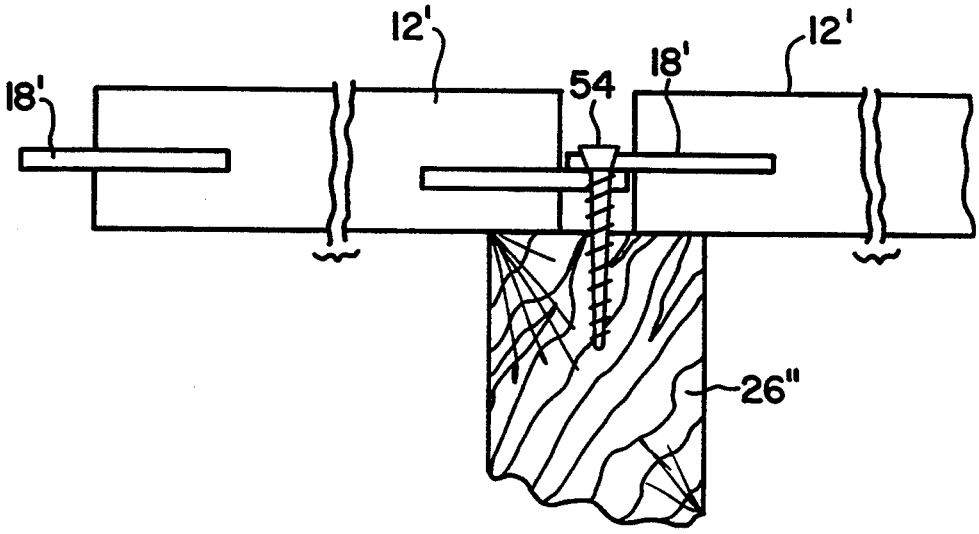
FIG. 11 is a view similar to FIG. 10 showing deck blocks with asymmetrical, extended splines, and hold-down screws.

In FIG. 11, the asymmetric deck blocks 12' having the laterally extended splines 18' arranged in vertically off-set relation, are secured by hold down screws 54 to the members of the sub-structure, to provide the required lateral restraint.

In both embodiments the deck system sub-structure is made up of a main frame of joists and headers supported upon piers or suitable posts or other footings, with cross-braces carried between the joists.

The use of sub-structure members of 6-foot and 8-foot members, usually comprising 6-foot joists and 8-foot headers.

In the case of the plain deck block embodiment the joists are preferably notched at one end, and the headers are un-notched.

The selection of 6 and 8-foot spans for the sub-structure main members then affords ready make-up of a range of deck sizes.

Thus typical deck sizes, (in fact) are:

| | | |
|---|---|---|
| 12 × 14 | 14 × 16 | 16 × 16 |
| 12 × 16 | 14 × 18 | 16 × 18 |
| 12 × 18 | 14 × 20 | 16 × 20 |
| 12 × 20, etc. | 14 × 22, etc. | 16 × 22, etc. |

The system thus makes possible an extremely wide range of pre-fabricated decks, using a minimum variety of components, namely 6-foot joists, 8-foot headers and cross-braces.

The only cutting that may be required of an erector, for certain sizes of deck, is the removal of some of the joist end tongues, by a simple single cut, in the case of the plain deck block embodiment.

INDUSTRIAL APPLICABILITY

Module blocks of square and also elongated planform, used on existing supports, or on a pre-fabricated support structure have wide applicability for replacement flooring and for new suspended structures, including walks and docks.

What I claim is:

1. A pre-fabricated decking modular block for surfacing a deck, the modular block having a top face and a reverse face and comprising:

a plurality of lateral bars, each said lateral bar having first and second longitudinal ends, each longitudinal end of each said lateral bar having a recess defined therein;

a first tie member splined into said recesses of said first ends of said lateral bars;

a second tie member splined into said recesses of said second ends of said lateral bars; and at least one fastener member piercing each said end of each said lateral bar and the respective tie member splined into the recess thereof whereby said lateral bars are secured in closely spaced, mutually parallel relation.

2. A modular block as in claim 1, wherein peripheral edges of said reverse face are recessed as a rabbet.

3. A modular block as in claim 1, wherein said tie members each project beyond the respective ends of said lateral bars to define a projecting flange.

4. A modular block as in claim 1, wherein said recesses are each parallel to and spaced from said top face and said reverse face.

5. A pre-fabricated deck system comprising:

a plurality of pre-fabricated modular blocks, each said pre-fabricated modular block having a top face and a reverse face and including a plurality of lateral bars, each said lateral bar having first and second longitudinal ends, each longitudinal end of each said lateral bar having a recess defined therein;

a first tie member splined into said recesses of said first ends of said lateral bars;

a second tie member splined into said recesses of said second ends of said lateral bars; and at least one fastener member piercing each said end of each said lateral bar and the respective tie member splined into the recess thereof whereby said lateral bars are secured in closely spaced, mutually parallel relation; and a deck sub-structure having a plurality of joist members and cross brace members secured therebetween to receive and support said modular blocks.

6. A system as in claim 5, wherein a peripheral edge of the reverse face of each said block is recessed as a rabbet to provide a close fit within said deck sub-structure.

7. A system as in claim 5, wherein each of said joist members and each of said cross-brace members have rabbetted upper edges, thereby defining seats for said blocks thereon.

8. A system as in claim 5, further comprising metal strips mounted along and secured solely to upper surfaces of said joist members and cross-brace members for limiting lateral displacement of said blocks relative to said upper surfaces.

9. A system as in claim 8, wherein said metal strips comprise strips disposed endwise in slots defined in said upper surfaces and extend upwardly therefrom between adjacent blocks.

10. A system as in claim 5, wherein said tie members each project beyond the respective ends of said lateral bars to define a projecting flange and tie members of adjacent blocks overlap when said blocks are mounted to said sub-structure, said system further comprising a plurality of screw-threaded fasteners extending through said overlapping tie members into said sub-structure so as to limit lateral movement of said blocks relative to said sub-structure.

11. A system as in claim 5, wherein said tie members are flexible and said bars are spaced along said tie members so that said blocks can be rolled up for transport.

* * * * *